US005226844A

United States Patent [19]

Müller

[11] Patent Number: 5,226,844

[45] Date of Patent: Jul. 13, 1993

[54] ACTUATOR FOR VARIABLE-PITCH PROPELLER

[76] Inventor: Peter Müller, Isengrund 9, CH-8134 Adliswil, Switzerland

[21] Appl. No.: 769,023

[22] Filed: Sep. 30, 1991

[30] Foreign Application Priority Data

Oct. 9, 1990 [DE] Fed. Rep. of Germany ..... 4031932

[51] Int. Cl.[5] ..... B63H 3/00; B63H 1/14; B63H 5/12; B63H 5/20

[52] U.S. Cl. ..... 440/50; 440/49; 440/53

[58] Field of Search ..... 440/50, 49, 53, 58, 440/61, 62, 64, 82

[56] References Cited

U.S. PATENT DOCUMENTS

| | | | |
|---|---|---|---|
| 2,704,991 | 5/1953 | Danielson | 440/50 |
| 2,931,443 | 2/1956 | Pehrsson | 440/50 |
| 4,929,201 | 5/1990 | Pitt | 440/50 |
| 4,964,822 | 10/1990 | Mueller | 440/50 |

*Primary Examiner*—Joseph F. Peters, Jr.
*Assistant Examiner*—Kenneth Lee
*Attorney, Agent, or Firm*—Herbert Dubno; Andrew Wilford

[57] ABSTRACT

A drive for a boat has a propeller hub rotatable about a main axis extending in a normal travel direction, a plurality of blades projecting generally radially of the main axis from the hub and each pivotal so as to be of variable pitch, and respective blade rods extending axially and displaceable axially relative to the hub to vary the pitch of the blades. A stator carried on the boat downstream in the direction from the hub and nonrotatable about the axis rotatably supports a cylinder housing that is releasably connected to the rods for joint axial movement therewith. A piston displaceable along the axis in the cylinder is releasably connected to the hub for joint axial movement therewith. Pressurizable lines extending through the stator are connected to the cylinder for alternately pressurizing the piston and thereby relatively axially shifting the rods and hub.

10 Claims, 2 Drawing Sheets

ACTUATOR FOR VARIABLE-PITCH PROPELLER

FIELD OF THE INVENTION

The present invention relates to a boat drive having a variable-pitch propeller. More particularly this invention concerns an actuator used in a marine application for such a propeller.

BACKGROUND OF THE INVENTION

A standard variable-pitch propeller has a rotary hub from which a plurality of blades project radially. These blades are each pivotal about a respective normally radial axis to change their angle. Different angles are more efficient at different speeds so that normally as speed increases the angle is changed appropriately. In addition reversing the pitch allows the boat provided with the variable-pitch drive to move backward.

In order to change the blade angles the relative axial positions of a coaxial core and sleeve of the propeller or of a propeller hub and respective blade rods are varied. This can be done manually in systems where the setting is only changed occasionally, but for boats where the angle is changed while the propeller is in use this is typically done by a hydraulic actuator. U.S. Pat. No. 4,880,402 describes such a system where the propeller-pitch actuator is provided inside or on the boat hull immediately upstream of the propeller. In this arrangement the outer sleeve is shifted to change pitch.

Commonly owned and copending U.S. patent application Ser. No. 07/635,739 (now U.S. Pat. No. 5,073,134) describes an arrangement where the cylinder is mounted immediately upstream of the propeller in its mounting bearing. Here the piston rod of the hydraulic cylinder projects axially through the variable-pitch propeller and is connected on the downstream side of the propeller with the adjustment rods.

The disadvantage of these systems is that they must all be incorporated in the variable-pitch propeller right from the start. They cannot be retrofitted to a variable-pitch propeller and each such actuator can only be used with a specific propeller. Servicing and/or replacing such an adjuster requires dismantling of the entire propeller assembly.

OBJECTS OF THE INVENTION

It is therefore an object of the present invention to provide an improved actuator for a variable-pitch propeller.

Another object is the provision of an improved boat drive having a variable-pitch propeller which overcomes the above-given disadvantages, that is whose adjuster can easily be retrofitted to such a propeller and, if necessary, removed and replaced fairly easily.

SUMMARY OF THE INVENTION

A drive for a boat according to the invention has a propeller hub rotatable about a main axis extending in a normal travel direction, a plurality of blades projecting generally radially of the main axis from the hub and each pivotal so as to be of variable pitch, and respective blade rods extending axially and displaceable relative to the hub to vary the pitch of the blades. A stator carried on the boat downstream in the direction from the hub and nonrotatable about the axis rotatably supports a cylinder housing that is releasably connected to the rods for joint axial movement therewith. A piston displaceable along the axis in the cylinder is releasably connected to the hub for joint axial movement therewith. Pressurizable lines extending through the stator are connected to the cylinder for alternately pressurizing the piston and thereby relatively axially shifting the rods and hub.

Thus the entire adjuster/actuator according to this invention is mounted aft of the propeller so that it can be installed, removed, and replaced without interfering with the drive structure that is invariably mounted forward of the propeller. A standard manually operable propeller can therefore be retrofitted with a hydraulically powered actuator, and a fixed-pitch propeller can even be replaced with a hydraulically actuated variable-pitch one relatively easily.

According to the invention an upright strut pivoted on the boat and on the stator allows limited displacement of the stator axially of the boat. Thus only the relative axial positions piston and cylinder elements of the pivots the blades for a very fine control of propeller pitch.

In accordance with a further feature of this invention the piston is provided with a rearwardly projecting piston rod and a sleeve fixed in the cylinder and coaxially surrounding the rod. The sleeve is formed with passages opening into the cylinder and connected to the pressurizable lines. In addition axially spaced bearings support the sleeve on the stator and the passages pass between the sleeve and stator in a region between the bearings.

Furthermore according to the invention the piston has a forwardly projecting piston rod threaded into the hub and the drive has an adjustment unit on the stator for manually rotating the piston relative to the hub and cylinder and relatively axially positioning the piston and hub. This adjustment unit can comprise an adjustment element that is axially displaceable and rotatable on the stator, a spring urging the element axially away from the piston, and axially interengageable coupling formations on the element and on the piston for rotationally coupling the element and piston when the element is pushed axially forward against the spring against the piston.

In order to provide a remote readout of blade pitch a coil is mounted on the stator and a magnetically sensible element is fixed on the piston adjacent the coil. Thus the inductance of the coil can be detected as an output corresponding to piston and blade position.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
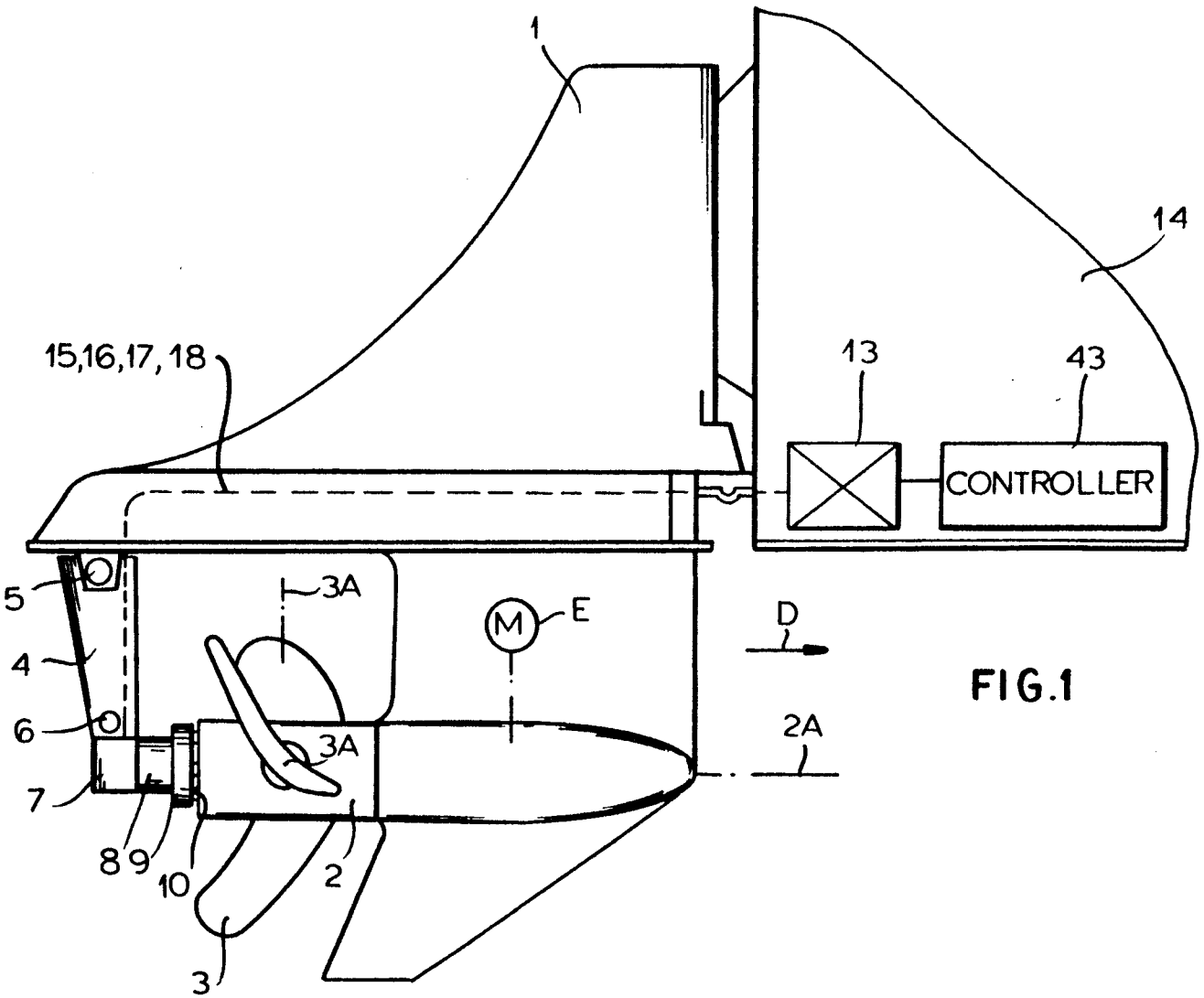
FIG. 1 is a small-scale side view of a boat stern and propeller drive according to the invention.

As seen in FIG. 1 a boat 14 has a Z-drive mount 1 on which a propeller hub 2 is rotatable about an axis 2A which extends in a normal travel direction D by a motor or engine indicated schematically at E. The propeller 2 has three blades 3 that are pivotal about respective blade axes 3A that are angularly equispaced about and that extend radially from the axis 2A. A rear support strut 4 is supported at its top end at an upper bumpertype pivot bolt 5 on the rear of the Z-mount 1 for pivoting about a horizontal axis perpendicular to the direction D and at a lower such pivot bolt 6 extending parallel to the bolt 5 and fixed in a stator housing 7.

An axially effective hydraulic actuator 8 fixed to axially extending and axially shiftable blade-adjustment rods 10 is rotatable in the stator 7 about the axis 2A. The actuator 8 comprises an outer cylinder housing 9 fixed to the rods 10 and rotatable with the blades 3 about the axis 2A and an internal piston 21 having an axially forwardly extending piston rod 44 which is threaded into a screwthread 24 formed in the rear end of a propeller shaft 12 fixed axially in the propeller hub 2 and an axially rearwardly extending piston rod 11. It is relative axial shifting of the rods 10 fixed in the housing 9 and of the shaft 12 that changes the angular positions of the blades 3 about their axes 3A as described in the above-cited patents and the references cited therein.

A schematically illustrated hydraulic pump 13 in the boat 14, which may also power the motor E, is connected through the stator 7 via pressurizable lines 15 and 16 and via a sump line to the actuator 8. An electric metering line 18 is also connected through the stator 7 to a controller shown schematically at 43. The lines 15 through 18 are flexible and all run through the strut 4 as well as through the stator 7.

Figure 2:
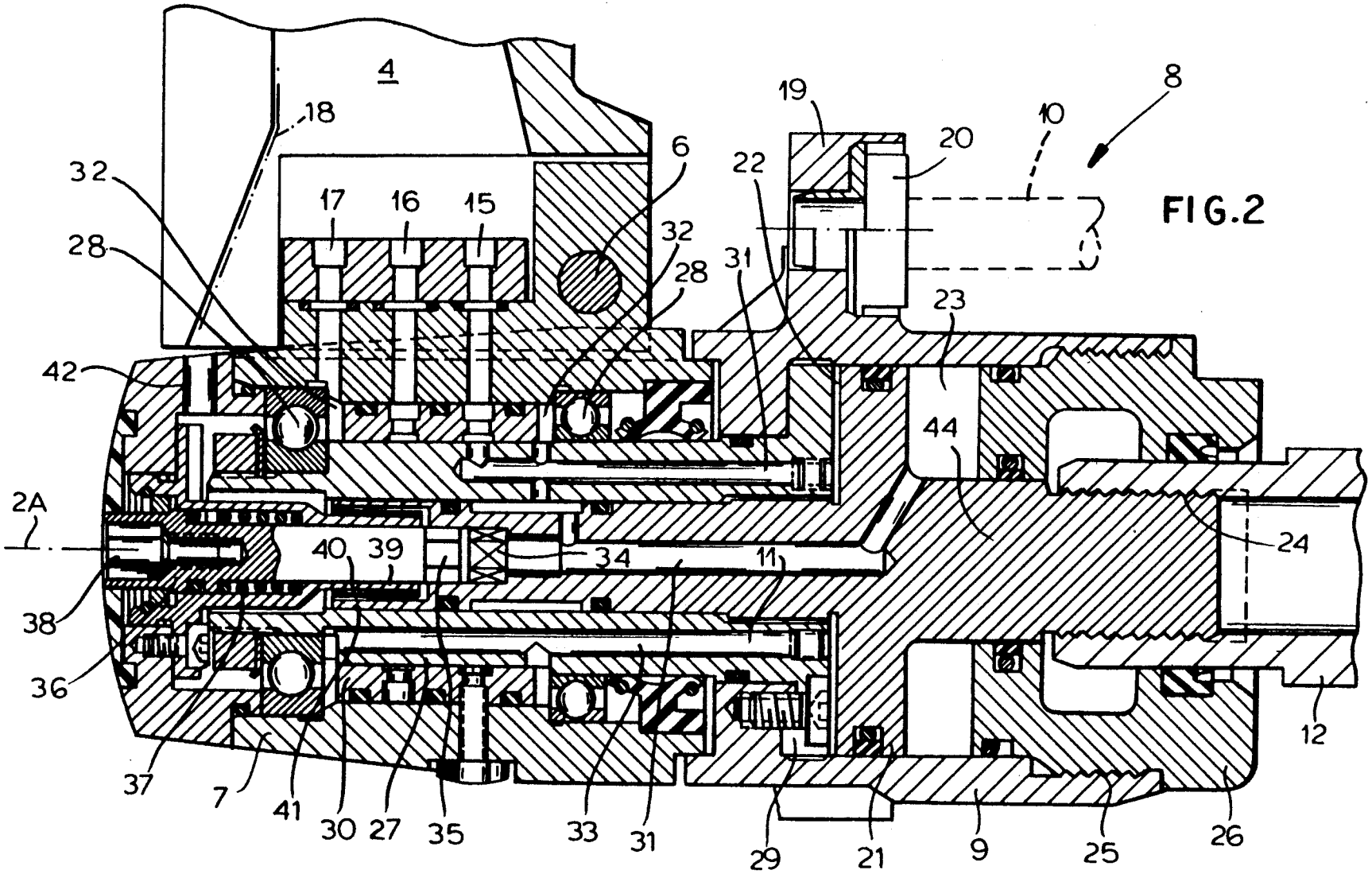
FIG. 2 is a vertical axial section through the propeller adjuster in accordance with this invention.

As seen in FIG. 2 the cylinder housing 9 is formed with three angularly equispaced lugs 19 each formed with a seat 20 in which the respective rod 10 is releasably received. The piston 21 defines in the housing 9 back and front compartments 22 and 23 so it is double-acting. The front end of the housing 9 is closed by a ring 26 surrounding the shaft 12 and threaded at 25 into the housing 9.

The rear extension 11 of the piston rod 11, 44 is surrounded coaxially by a sleeve 27 bolted via a flange 29 to the housing 9 and supported by front and rear roller bearings 28 in the nondisplaceable stator 7. Passages such as shown at 31 in the sleeve 27 and housing 9 extend through a distribution ring 30 to connect with the alternately pressurizable lines or passages 15 and 16. The sump line 17 is connected via a passage 33 to compartments 32 that are adjacent the bearings 28 and that serve to catch any leakage from the lines 15 and 16, which leakage lubricates the bearings 28.

A rearwardly open hexagonal seat 34 formed in the rear end of the rear piston rod 11 can receive a hexagonal front end 35 of an axial pin 36 that is urged axially backward by a spring 37 and that has at its rear end a hexagonal socket 38. The spring 38 pulls the pin 36 out of the socket 34. When the propeller 2 is stopped it is possible to insert a wrench or key in the socket 38 to push the end 34 into the seat 35 and then manually screw the piston 21 in the screwthread 24 of the shaft 12, thereby allowing the base position of the propeller blades 3, that is their pitch when the piston 21 is in its rearmost end position, to be set.

A coil 40 provided on a front end 39 of the pin 36 is normally at least partially covered by an axially rearwardly projecting skirt 41 of the rear piston rod 11 which is made of steel. The metering line 18 extends through a hole 42 in the stator 7 to connect between this coil 40 and the controller 43 to monitor the relative axial position of the stator 7 and the shaft 12, providing a remote readout of propeller pitch.

I claim:

1. A drive for a boat, the drive comprising:

a propeller hub rotatable about a main axis extending in a normal travel direction;

a plurality of blades projecting generally radially of the main axis from the hub and each pivotal so as to be of variable pitch;

respective blade rods extending axially and displaceable axially relative to the hub to vary the pitch of the blades;

a stator carried on the boat downstream in the direction from the hub and nonrotatable about the axis;

a cylinder housing journaled on the stator for rotation about the axis and releasably connected to the rods for joint axial movement therewith;

a piston displaceable along the axis in the cylinder, having a forwardly projecting piston rod threaded into the hub, and releasably connected to the hub for joint axial movement therewith;

adjustment means on the stator for manually rotating the piston relative to the hub and cylinder for relatively axially positioning the piston and hub; and control means including pressurizable lines extending through the stator and connected to the cylinder for alternately pressurizing the piston and thereby relatively axially shifting the rods and hub.

2. A drive for a boat, the drive comprising:

a propeller hub rotatable about a main axis extending in a normal travel direction;

a plurality of blades projecting generally radially of the main axis from the hub and each pivotal so as to be of variable pitch;

at least one blade rod extending axially and displaceable axially relative to the hub to vary the pitch of the blades;

a stator carried on the boat downstream in the direction from the hub and nonrotatable about the axis;

a cylinder element journaled on the stator for rotation about the axis;

a piston element axially displaceable in the cylinder element, one of the elements being releasably connected to the rods for joint axial movement therewith and the other element being releasably connected to the hub for joint axial movement therewith; and control means for alternately axially oppositely pressurizing the piston element and thereby relatively axially shifting the rod and hub.

3. The boat drive defined in claim 2, further comprising means including an upright strut pivoted on the boat and on the stator for limited displacement of the stator axially of the boat.

4. The boat drive defined in claim 2 wherein the piston element is provided with a rearwardly projecting piston rod and a sleeve fixed in the cylinder element and coaxially surrounding the rod, the sleeve being formed with passages opening into the cylinder element and connected to the pressurizable lines.

5. The boat drive defined in claim 4, further comprising axially spaced bearings supporting the sleeve on the stator, the passages passing between the sleeve and stator in a region between the bearings.

6. The boat drive defined in claim 2 wherein the piston element has a forwardly projecting piston rod threaded into the hub, the drive further comprising adjustment means on the stator for manually rotating the piston element relative to the hub and cylinder element for relatively axially positioning the piston element and hub.

7. The boat drive defined in claim 6 wherein the adjustment means includes an adjustment element that is axially displaceable and rotatable on the stator, a spring urging the adjustment element axially away from the piston element, and axially interengageable coupling formations on the adjustment element and on the piston element for rotationally coupling the adjustment element and piston element when the piston element is pushed axially forward against the spring against the piston element.

8. The boat drive defined in claim 2, further comprising sensor means including a coil on the stator, and a magnetically sensible element fixed on the piston element adjacent the coil for providing an output corresponding to the relative axial position of the piston element and the stator.

9. The boat drive defined in claim 2 wherein the blade rods have rear ends and the stator has respective forwardly open seats releasably receiving the rod ends.

10. The boat drive defined in claim 9 wherein the piston element has a forwardly projecting piston rod and the hub has a rearwardly projecting shaft threaded axially onto the piston rod.

* * * * *